United States Patent [19]

O'Brien et al.

[11] 3,949,466

[45] Apr. 13, 1976

[54] PROCESS FOR FORMING AN ALUMINUM ELECTRICAL CONDUCTING WIRE JUNCTION END PIECE

[75] Inventors: John L. O'Brien, Winchester; Philip C. Johnson, Carlisle; D. William Lee, Concord, all of Mass.

[73] Assignee: Arthur D. Little Inc., Cambridge, Mass.

[22] Filed: May 28, 1974

[21] Appl. No.: 473,516

[52] U.S. Cl. ..... 29/628; 29/630 A; 72/258; 228/113; 228/115; 339/275 T

[51] Int. Cl.[2] ..... H01R 43/00

[58] Field of Search ..... 29/470.1, 473.1, 628, 629, 29/630 R, 630 A; 72/258; 339/275 R, 275 T, 276 R, 276 T, 278 R, 278 T; 228/113, 115

[56] References Cited

UNITED STATES PATENTS

| | | | |
|---|---|---|---|
| 2,799,840 | 7/1957 | Barnes | 339/275 T |
| 2,806,215 | 9/1957 | Redslob | 339/276 T |
| 3,096,577 | 7/1963 | Carlson et al. | 29/473.3 |
| 3,233,211 | 2/1966 | Smith | 339/258 R |
| 3,656,092 | 4/1972 | Swengel et al. | 339/223 R |
| 3,664,012 | 5/1972 | Wilke et al. | 72/258 |
| 3,728,781 | 4/1973 | Curtis et al. | 29/470.3 |
| 3,780,554 | 12/1973 | Nilsson | 72/258 |
| 3,803,892 | 4/1974 | Yamaguchi et al. | 72/258 |
| 3,842,487 | 10/1974 | Hartz | 29/470.1 |

OTHER PUBLICATIONS

Metals Handbook, Vol. 6, Friction Welding, pp. 514 and 515, 8th Ed., 1971.

*Primary Examiner*—C. W. Lanham
*Assistant Examiner*—James R. Duzan
*Attorney, Agent, or Firm*—Bessie A. Lepper

[57] ABSTRACT

A process for bonding a copper or nickel end junction piece to an aluminum electrical conductor wire. The copper or nickel end junction piece is used to make the electrical connection with terminals in meters, fuse boxes, switches and the like, thus eliminating such junctions with the aluminum wire and hence eliminating the possibility of the formation an aluminum oxide connection which may give rise to overheating and subsequent fire. The end junction pieces may be applied on-site after the aluminum wire is cut to the desired length. No special pretreatment of the aluminum wire end is necessary prior to the addition on the end junction piece.

11 Claims, 15 Drawing Figures

PROCESS FOR FORMING AN ALUMINUM ELECTRICAL CONDUCTING WIRE JUNCTION END PIECE

This invention relates to aluminum electrical conductor wire and more particularly to such aluminum wire having a junction end piece bonded thereto for making a safe, permanent, electrical contact with a terminal.

Aluminum wire is now used extensively as an electrical conductor. For example, virtually all distribution conductors, running between transformer centers and local transformers, are now aluminum. Moreover, a major percentage of the service drop conductors, running between local transformer and the houses or buildings connected to such transformers, and a major percentage of the service entrance cables running from the service drop conductors to meters and from meters to the service equipment inside houses or buildings are formed of aluminum. In addition, it has been estimated that about 20 percent of feeder cables from main panelboards to remote points and about 15 percent of branch circuit wiring, extending from fuses or circuit breakers to distribution points within houses, are presently formed of aluminum. Although this invention is primarily concerned with the so-called service entrance cables, conductors for 15- and 20- ampere circuits and the so-called branch circuit wiring, it is applicable to solid aluminum wires suitable for all of the above-named applications.

An aluminum conductor typically exhibits about 61% of the electrical conductivity of a copper conductor of the same diameter; but copper weighs about three times as much as aluminum and, at present, costs some three times as much per pound. This means that one pound of aluminum is required in place of about two pounds of copper, a fact which in turn means that aluminum wiring is more easily and economically handled and installed, and requires less supporting structure. The difference in cost between aluminum and copper is even more pronounced, for assuming that the cost of copper remains three times that of aluminum it will be seen that the cost of copper on an equal performance basis is some six times that for aluminum. Furthermore, the supply of copper can be erratic, making it difficult at times to obtain sufficient copper for electrical wiring.

Aluminum therefore appears to be an ideal substitute for copper in many types of electrical conductors. It does, however, have one drawback and that is that aluminum electrical conductor wire has been known to overheat at terminals and result in fires. It is generally believed that the cause of the overheating of aluminum wires at the terminals is due to the formation of aluminum oxide on the surface of the wire. Aluminum oxide is a good dielectric and the high resistance generated in any aluminum oxide layer which may form on the wire at the terminal contact results in undue heat generation.

Several techniques have been developed for overcoming this problem of heat generation brought about through oxidation of the contacting aluminum wire surface. One such technique comprises cladding the entire length of the aluminum wire with a sheath of copper. Contact is then made between the copper cladding and the terminal. Since the copper cladding is metallurgically bonded to the aluminum, there is no formation of aluminum oxide at this interface. Although this approach is technically sound, it does not have economic merit since it still requires a considerable amount of copper and involves the added cost of applying the copper cladding to the aluminum. It has also been suggested to alloy the aluminum with a suitable metal to improve creep resistance which in turn should minimize oxide formation. However, this alloying decreases the conductivity of the resulting wire.

Another technique for overcoming the necessity for making terminal contacts with aluminum wire is the practice of "pigtailing" or attaching a short length of copper wire to the aluminum with a twist-on connector. The copper wire end is then attached to the terminal junction. This technique has the disadvantage that the connection between the copper and aluminum may not always be of a nature to prevent oxidation of at least part of the aluminum surface.

Since only a short length of copper wire is required at the end of the aluminum wire, it would appear that by conventional metal fusion welding techniques, the copper end junction piece could be bonded to the aluminum wire. This, however, is not workable since this technique results in the formation of intermetallic compounds of copper and aluminum at the bond. These intermetallic compounds are brittle and therefore lack the necessary ductility as well as tensile and bending strengths required of the wire.

Although the prior art techniques used for form a non-oxidizing junction for aluminum electrical conductors with terminals has normally used copper (cladding bonded to the entire wire length or a short piece "pigtailed" on the end) it is also possible to form the end junction piece from nickel metal. However, copper is preferred for most aluminum wire and most uses since it is less expensive and has higher conductivity. In the detailed description of this invention which follows, the end junction piece is referred to, for convenience, as a copper end junction piece since it represents the preferred embodiment of the two metals. However, it is within the scope of this invention to use nickel in forming the end junction piece and the same processes described for copper are applicable to nickel.

It would therefore be desirable to have a process for forming a bond between a relative short length of copper or nickel used as a junction end piece and the end of an aluminum wire, the bond being of a nature to eliminate or minimize the formation of aluminum oxide, to possess the ductility and tensile and bending strengths associated with the aluminum wire, and to lend itself to being effected at installation sites.

It is therefore a primary object of this invention to provide a process for joining copper or nickel end junction pieces to aluminum electrical conductor wire to form a bond which eliminates or minimizes the possibility of the formation of aluminum oxide and which possesses ductility and tensile and bending strengths at least as great as the aluminum wire so bonded. Another object of this invention is to provide such a process which forms a solid state bond between a copper or nickel end junction piece and an aluminum wire so that the resulting copper-ended or nickel-ended aluminum wire may be used with standard terminal connections.

It is another primary object of this invention to provide a process for affixing a junction end piece to aluminum conductor wires to render them completely reliable for installation as residential electrical branch circuits including, but not limited to, 15- and 20-ampere circuits, for use as connectors from service entrances to the branch circuits, and for use in appliance wiring. An additional object is to provide such a process which constitutes an inexpensive way of making safe connections for aluminum conductor wires of all sizes. Still another object is to provide a process of the character described which may be performed at the site of the installation of the aluminum wire after it is cut to a desired length.

Yet another primary object of this invention is to provide an improved aluminum electrical conducting wire with a copper or nickel end junction bonded thereto. A further object of the invention is to provide an aluminum electrical conductor wire of the character described in which the bond is a solid state bond having tensile and bending strengths at least as great as those of the aluminum wire. A further object is to provide an aluminum electrical conductor wire which is entirely reliable and safe from the possibility of overheating at terminal junctions, the aluminum wire being particularly suitable for use as service entrance cables, feeder cables, branch circuits and appliance wiring.

Other objects of the invention will in part be obvious and will in part be apparent hereinafter.

By the process of this invention the copper or nickel junction end piece is bonded to the aluminum conductor wire to form a solid state bond, the area of which is sufficient to give the bond a tensile strength and bending strength at least as great as that of the aluminum conductor. The bond is further characterized as being essentially free from aluminum oxide and intermetallics and the cross section through the length of the bonding section is essentially constant and equivalent to the cross section of the aluminum conductor. The solid state bond is preferably acheived through cold extrusion. However, solid state welding, such as may be achieved through friction or ultrasonic welding techniques, may also be used.

The invention accordingly comprises the several steps and the relation of one or more of such steps with respect to each of the others, and the articles possessing the features, properties, and the relation of elements, which are exemplified in the following detailed disclosure, and the scope of the invention will be indicated in the claims.

For a fuller understanding of the nature and objects of the invention, reference should be had to the following description taken in connection with the accompanying drawings in which FIG. 1 is a perspective view of one embodiment of an aluminum conductor having a copper end junction in accordance with this invention;

Several grades and gages of aluminum electrical conductor wire are used for the different applications previously detailed. Although the process of this invention is applicable to all of these grades and gages, it is particularly suitable for that grade termed "EC" by Underwriters Laboratory. The grade of aluminum wire is a solid wire having a tensile strength between about 15,000 and 22,000 psi and an elongation of 10% minimum. It is classed as an intermediate-temper product and referred to as "semiannealed." The aluminum is 99.45+% pure with an electrical conductivity of 61% IACS (International Annealed Copper Standard). The wire may have a nonmetallic sheath as an insulator, is sold in Nos. 12-4 AWG (American Wire Gage), i.e., has a diameter ranging between 0.08081 and 0.2043 inch, and is used in service entrance cables, feeder cables and branch circuit wiring. Normally it is connected to the wire-binding screw terminals of attachment plug receptacles, wall outlet snap switches, fuse boxes, circuit breakers and the like. In addition to this type of aluminum electrical conductor wire, hard-drawn wires of greater diameters are used for utility overhead conductors such as transmission and service drop cables. The process of this invention is applicable to these types of wires as well as to any form of solid aluminum electrical conductor wire.

In describing the process and article of this invention with reference to the drawings, the junction end piece will be referred to as a copper junction end piece. However, as previously noted, it may also be formed of nickel.

Figure 1:
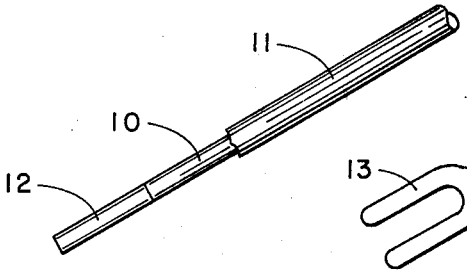
Figure 2:
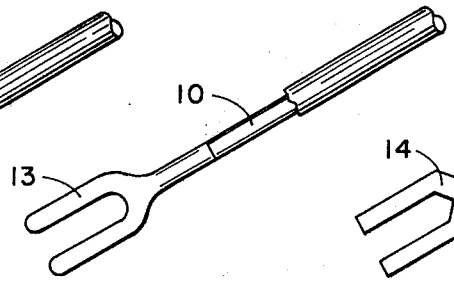
FIG. 2 is a perspective view of another embodiment of the aluminum conductor of this invention in which the copper end junction has preformed prongs.
Figure 3:
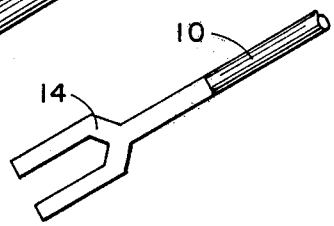
FIG. 3 is a perspective view of a modification of the embodiment of FIG. 2 in which the pronged copper junction is formed during the bonding.

The copper end junction on the aluminum electrical conductor wire of this invention may take several forms, two of which are illustrated in FIGS. 1–3. In FIG. 1, the aluminum wire 10, with nonmetallic sheath 11, has a copper end junction 12 bonded thereto to form a wire of essentially constant diameter. The copper end junction 12 need only be long enough to provide a sufficient length for making the necessary contact with a terminal post or other connector means. FIGS. 2 and 3 show the copper end junction in the form of a preformed prong 13 or of a prong 14 shaped in the formation of the solid state bond. The process for forming the conductor wires shown in FIGS. 1–3 will be described below.

The copper used in the formation of the end junction piece is high-purity, standard electrical conducting grade copper. Such copper has a tensile strength and bending strength somewhat greater than aluminum wire of the same diameter, a fact which means that the solid state bond formed must have a ductility and tensile and bending strengths of at least that of the aluminum electrical conductor wire.

One preferred way of forming the required solid state bond between the aluminum and copper in accordance with this invention is through cold extrusion. This process lends itself to onsite operation and possesses two other distinct advantages. The first of these advantages is that the mechanical disruption and dispersion of the surface oxides by surface deformation eliminates any need for a special pretreatment of the surfaces to be bonded to remove surface oxides. The second advantage lies in the fact that a significant new amount of metallic surface contact area is created by bulk deformation of the metal pieces thus giving rise to a bonding area considerably greater than any original contact area between the end of the aluminum conductor wire and the end of a copper junction end piece.

Figure 4:
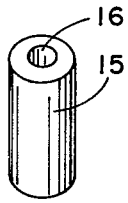
FIG. 4 is a perspective view of a copper sleeve used in forming the copper end junction through cold extrusion.
Figure 5:
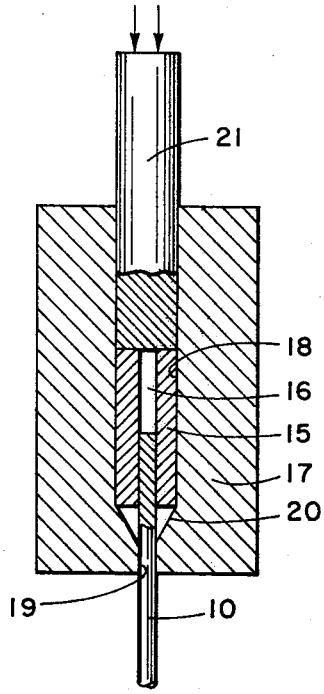
FIG. 5 is a cross section of an exemplary die and punch which may be used to cold extrude the copper sleeve of FIG. 4 to the aluminum conductor wire to form the copper junction end piece.
Figure 6:
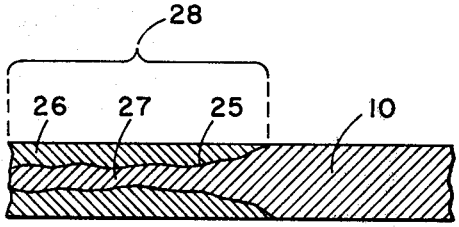
FIG. 6 is an enlarged cross section of the aluminum conductor wire, such as shown in FIG. 1 with the copper junction end piece of this invention formed by the process illustrated in FIG. 5.
Figure 7:
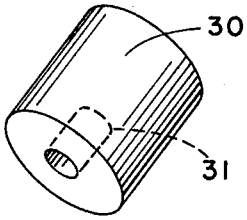
FIG. 7 is a perspective view of a copper slug suitable for joining by cold extrusion ot the aluminum conductor wire to form a pronged copper junction end piece such as shown in FIG. 3.
Figure 9:
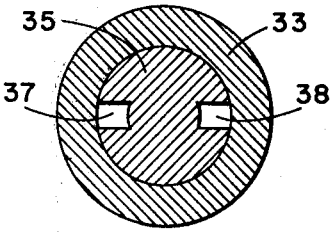
FIG. 9 is a cross section of the die and punch of FIG. 8 taken through plane 9—9 of FIG. 8.

One form of cold extrusion which may be used to form the wire of FIG. 1 is illustrated in FIGS. 4–6. In this process a copper sleeve 15 (FIG. 4) is extruded around the aluminum wire 10 using forward extrusion. Exemplary of the equipment which may be used to perform this extrusion is the die and punch shown in FIG. 5. The diameter of internal passage 16 of copper sleeve 15 is slightly greater than the outside diameter of aluminum wire 10 so that the wire may be easily inserted into passage 16 without requiring perfect alignment of the sleeve within the die cavity. As shown in FIG. 5, copper sleeve 15 is placed into the die cavity of die 17. The die cavity has a large-diameter entrance section 18 sized to fit the copper sleeve 15 and a smaller-diameter exit section 19 sized to permit the aluminum wire to be easily inserted through it. These two sections are joined by a frustoconical section 20 on the upper edge of which the copper sleeve rests prior to extrusion. As an alternate configuration, sleeve 15 may be constructed to have an end tapered to fit frustoconical section 20 of the die cavity. The die punch 21 is sized to make a slidable fit within section 18 of the die cavity in accordance with well-known extruder design principles.

The preferred outside diameter of the copper sleeve is from about 1.25 to about 2 times the outside diameter of the aluminum conductor wire to which the copper sleeve is to be bonded. The length of the copper sleeve used can readily be determined for any aluminum wire and it will depend upon the outside diameter of the copper sleeve relative to that of the aluminum wire and upon the desired final length of the copper junction end piece. As an example, the copper junction end piece should be about ⅝ inch long for branch circuit wiring.

In bonding the copper sleeve to the aluminum wire to form the copper junction end piece, the copper sleeve is dropped in die cavity section 18 and the aluminum wire is inserted through die cavity section 19 to extend up into passage 16 of copper sleeve 15. The aluminum wire need not extend through the entire length of the copper sleeve at the beginning of the extrusion process when punch 21 makes contact with the sleeve. As punch 21 is forced into the die cavity to achieve forward extrusion, the copper sleeve is forced to assume the configuration of the smaller-diameter die section 19 and the aluminum wire is forced upward into the copper sleeve. The resulting conductor wire is illustrated in enlarged cross section in FIG. 6.

It will be seen in FIG. 6 that an extended bond 25 is formed between the copper 26 and aluminum 27 over what for convenience is referred to as bonding section 28 extending between the dotted lines. The bonding section may be defined as that length of the wire over which a solid state bond between the aluminum and copper extends. Microscopic examination of the bond 25 shows the formation of an intimate metal-to-metal contact. As shown in FIG. 6, the solid state bond formed in this manner exhibits an undulatory configuration which adds to the strength of the bond by increasing the bonding surface and by effecting an interlocking of the copper and aluminum.

The force required to perform the forward extrusion process of FIG. 5 is of the order of about one thousand pounds. Such forces can be achieved with mechanically, hydraulically or pneumatically actuated cylinders small enough to be contained in a hand-held tool. Thus, the copper end junctions may be applied onsite. In using aluminum wiring the electrician can cut the aluminum conductor wire to its desired length, bond on the copper end piece and connect it in the usual manner to a standard terminal, making the terminal connection through the copper end junction. Because of the nature of the bond formed, it has ductility and tensile and bending strengths equivalent to or greater than the aluminum wire itself and therefore the copper ended wire may be bent without fear of breaking or altering the character of the bond. Since the terminal junction is made through a copper surface and not through an aluminum surface which can be oxidized, the possibility of overheating with resulting fire is eliminated.

Figure 8:
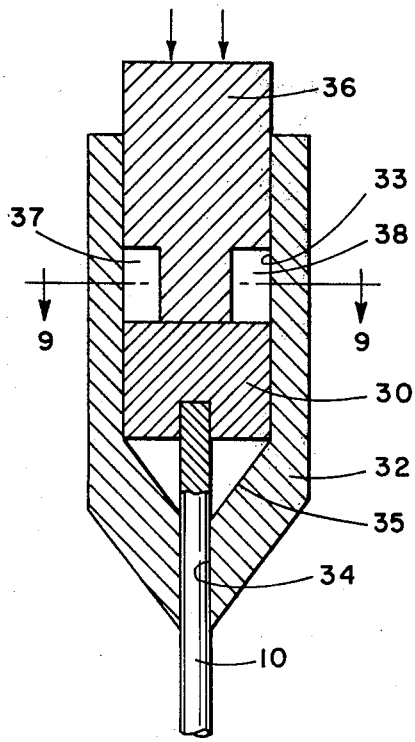
FIG. 8 is a cross section of an exemplary die and punch which may be used to cold extrude the copper slug of FIG. 7 to the aluminum conductor wire.

A combination of forward and backward extrusion may be used to bond a copper end junction onto an aluminum conductor wire to form a pronged copper junction in the extruding. This embodiment of the process of this invention is illustrated in FIGS. 7–10. The copper piece used is in the form of a slug 30 (FIG. 7) with a centrally located well 31 having a diameter slightly larger than the diameter of the aluminum conductor wire to which it is to be bonded. The well 31 extends through only a partial thickness of the copper slug. The die 32 is formed to have a die cavity with a larger-diameter entrance section 33 sized so that slug 30 fits therein and a smaller-diameter exit section 34 sized to permit the aluminum conductor wire 10 be easily slipped through. The two sections 33 and 34 are connected through a frustoconical section 35. It is preferable in the exit sections of the dies of FIG. 5 and FIG. 8 to provide for a relatively loose fit with the aluminum conductor wire so that the wire may be easily inserted into the die cavity and may experience a small lateral movement to adjust for any slight off-center of the passage in the copper sleeve (FIG. 5) or of the well in the copper slug (FIG. 8).

Figure 10:
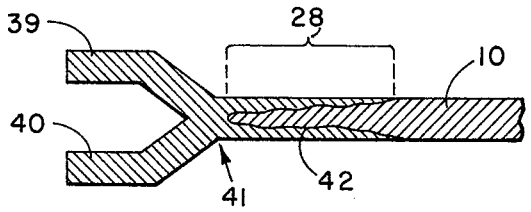
FIG. 10 is a cross section of the aluminum conductor wire, such as shown in FIG. 3, with the pronged copper junction end piece formed by the process illustrated in FIG. 8.

The punch 36 of the extrusion mechanism of FIG. 8 is cut to have two oppositely disposed slots 37 and 38 into which a portion of the copper slug 30 is back extruded to form the tines 39 and 40 of the pronged copper end junction 41 of FIG. 10. As in the case of the process embodiment of FIG. 5, the solid state bond 42 (FIG. 10) between aluminum conductor wire 10 and copper end junction 41 extends over a relatively large area, is undulatory in configuration, and possesses high ductility and high tensile and bending strengths.

Figure 11:
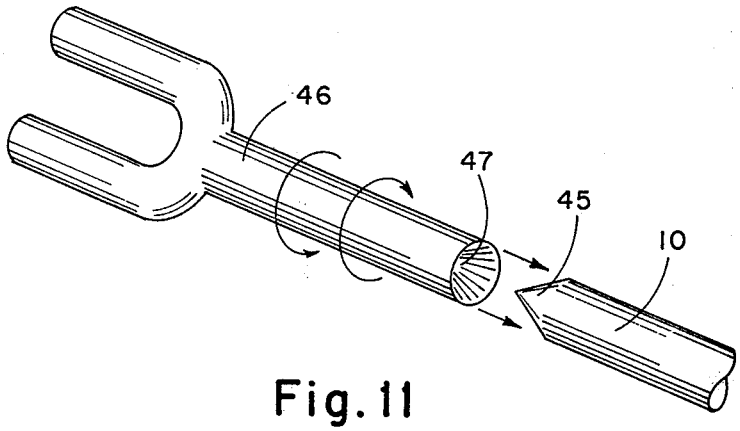
FIG. 11 illustrates the formation of the aluminum conductor wire of this invention, such as shown in FIG. 2, by solid state welding using conically configured bonding surfaces.
Figure 12:
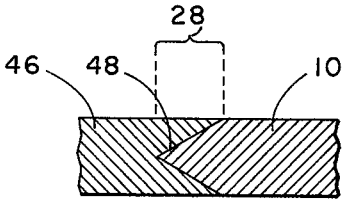
FIG. 12 is a cross section of the bonded section of a conductor formed by the process of FIG. 11.

FIGS. 11 and 12 illustrate the use of a type of solid state welding process suitable for attaining the required solid state bond between the aluminum conductor wire and the copper end junction piece. In this welding procedure bulk plastic flow is not used; rather, the copper surface to be bonded is moved relative to the aluminum surface to produce surface shear to disrupt and disperse the oxides and achieve the copper-aluminum solid state bond. Solid state welding, as the term is used herein, includes those form of welding capable of producing a solid state bond. Exemplary of well-known solid state welding techniques are friction welding, inertial welding, ultrasonic welding and the like.

In FIG. 11, the areas of the contacting surfaces are extended by cutting the end of the aluminum conductor wire 10 to have a conical point 45 and providing the copper end junction piece 46 to have a conically-shaped cavity 47. Angular motion is then imparted to the copper junction end piece 46 by rotating or oscillating it about its axis and simultaneously, under axial loading, forcing it into contact with the conical end of aluminum conductor wire 10 which is held firmly immobilized. Relative motion (rotary or oscillatory including frequencies associated with ultrasonic bonding) may be imparted by suitable means using electrical, mechanical, pneumatic, hydraulic or propellant energy sources. Suitable solid state metallurgical bonds can be achieved between copper and aluminum in relative rotary motion of, for example, from 500–1000 surface feet per minute using axial loads up to the equivalent of the yield point of the aluminum.

The use of the welding technique illustrated in FIG. 11 gives rise to a bond 48 of the type shown in FIG. 12. The bonding surface area (surface area between copper and aluminum) is smaller and the bonding section 28 is shorter than in the case where bulk plastic deformation is effected by extrusion. However, the oxides are sufficiently disrupted to create an effective solid state bond having the required ductility and tensile and bending strengths.

Figure 13:
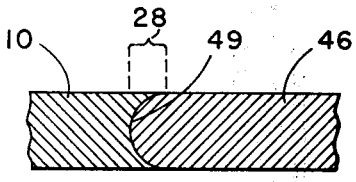
FIG. 13 is a cross section of the bonded section of a conductor formed by the process of FIG. 11 using hemispherically configured bonding surfaces.
Figure 14:
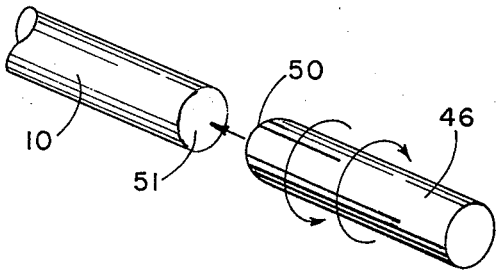
FIG. 14 illustrates the formation of the aluminum conductor wire of this invention, such as shown in FIGS. 1 or 2, by solid state welding using bonding surfaces which are planar and normal to the axis of the wire.
Figure 15:
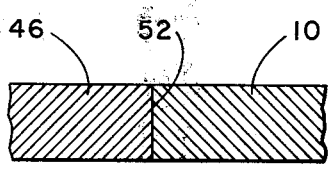
FIG. 15 is a cross section of the bonded section of a conductor formed by the process illustrated in FIG. 14.

It is also, of course, within the scope of this invention to use a straight piece of copper wire, in place of the pronged piece 46 of FIG. 11, as the copper end junction. It is further within the scope of this invention to use hemispherically shaped contacting ends for the copper piece and the aluminum wire in place of the conically configured surfaces 45 and 47 of FIG. 11 to form a bond 49 as illustrated in FIG. 13. Likewise it is possible to use planar surfaces 50 and 51 (FIG. 14) which are perpendicular to the axes of the copper piece and aluminum wire to form a bond 52 (FIG. 15) having a surface area approximating the cross sectional area of the wire. In such an embodiment of the solid state bond, the length of the bonding section is essentially zero. In most instances, those bonds (such as 25 of FIG. 6, 42 of FIG. 10, 48 of FIG. 12 and 49 of FIG. 13) are preferred wherein the surface area of the bond is larger than the cross sectional area of the wire normal to the wire axis and wherein the bond has a finite length. The planar bond of FIG. 15 is useful only for the larger diameter wires.

The following example, which is meant to be illustrative and not limiting, further illustrates this invention.

Aluminum electrical conductor wire, with a diameter slightly less than that of No. 10 AWG, was used and the copper end junction piece was bonded on by the method of forward extrusion illustrated in FIGS. 4–6. Prior to being placed in the die cavity the end of the aluminum wire was wiped off to remove any residue left after stripping off the insulation. No special treatment was given the aluminum wire end. The forward extrusion die used had an entrance cavity inside diameter twice the inside diameter of the exit cavity which was 0.099 inch and sized to be slightly larger than the outside diameter of the aluminum wire. The copper sleeve used was ⅜ inch long and had an outside diameter slightly less than the diameter of the entrance cavity and an inside diameter sized to make a loose fit over the aluminum wire. The copper sleeve and aluminum wire were assembled in the extrusion die as shown in FIG. 5. The punch was driven by the crosshead of a mechanical testing machine with a force of about 1000 psi and the copper and aluminum were extruded through the die exit to give the structure shown in cross section FIG. 6. The diameter of the resulting copper-ended wire, forming the copper junction end piece, was essentially equal to that of the original aluminum wire to which it was bonded. The copper occupied an average of about 75% of the cross sectional area of the bonded section and the aluminum about 25%. Metallographic examination showed that the aluminum was in physical contact with the copper and that the interface between aluminum and copper was irregular (undulatory), tending to key the metals together.

By the process of this invention it is possible to affix junction end pieces to the ends of aluminum electrical conductor wire at the site at which it is installed, this in turn eliminates the need for forming a pressure junction with an aluminum wire surface which later may be subject to oxidation to form a layer of dielectric aluminum oxide between the terminal point to which the wire is affixed. As a result, the possibility of overheating of the aluminum wire at the junction is eliminated or minimized. The copper, or nickel, junction end piece is used only as a short length, making it possible to use the less expensive, all-aluminum wire for all but the short end junctions. Thus this invention makes it possible to realize the full potential of aluminum wiring along with all of its advantages without encountering the inherent risk of junction overheating and perhaps resulting fires.

It will thus be seen that the objects set forth above, among those made apparent from the preceding description, are efficiently attained and, since certain changes may be made in carrying out the above process and in the article set forth without departing from the scope of the invention, it is intended that all matter contained in the above description or shown in the accompanying drawings shall be interpreted as illustrative and not in a limiting sense.

We claim:

1. A process for affixing to the terminal end of a solid aluminum electrical conductor wire a junction end piece whereby said aluminum wire is connectable to an electrical terminal through said junction end piece, comprising the step of effecting a direct solid state bond solely between said terminal end of said solid aluminum wire and said junction end piece, the surface area of said bond being appreciably greater than the cross sectional area of said wire normal to the wire axis and extending over a bonding section of finite length while maintaining the cross sectional area of said junction end piece throughout said bonding section substantially equal to the cross sectional area of said aluminum wire.

2. A process in accordance with claim 1 wherein said step of effecting said solid state bond comprises cold extruding said junction end piece around terminal end of said said aluminum wire thereby forming said solid state bond through bulk deformation of the metal in said wire and said junction end piece.

3. A process in accordance with claim 1 including the step of extending the surface areas of said terminal end of said aluminum wire and of the contacting end of said junction end piece prior to effecting said solid state bond and wherein said step of effecting said solid state bond comprises immobilizing said aluminum wire, imparting angular motion to said junction end piece, contacting said terminal end of said aluminum wire with the end of said junction end piece, and applying an axial loading to said junction end piece in the direction of said aluminum wire, thereby mechanically disrupting and dispersing the surface oxides on the contacting ends of said aluminum wire and said junction end piece to permit metal-to-metal contact in forming said solid state bond.

4. A process for joining to the terminal end of a solid aluminum electrical conductor wire a junction end piece whereby said aluminum wire is connectable to an electrical terminal through said junction end piece, comprising the steps of a. placing a sleeve having an internal passage and being of the material used to form the junction end piece into the die cavity of a forward extruder, said die cavity having an exit section of cross sectional area smaller than that of said cavity and joined thereto through a frustoconical section, the internal passage of said sleeve and said exit section of said extruder being sized to make a loose fit with said aluminum wire;

b. inserting said terminal end of said aluminum wire through said exit section of said extruder and into said internal passage of said sleeve to extend at least partially therethrough;

c. cold extruding said sleeve with said aluminum wire therein through said exit section, whereby said sleeve is joined to said aluminum wire through plastic deformation by a solid state bond of finite length to form said junction end piece having a cross sectional area substantially equal to the cross sectional area of said wire.

5. A process in accordance with claim 4 wherein said sleeve is formed of high-purity electrical conducting grade copper.

6. A process in accordance with claim 5 wherein said sleeve has a tapered end to fit the configuration of said frustoconical sectión of said extruder.

7. A process in accordance with claim 4 wherein said outside diameter of said copper sleeve ranges between about 1.25 and about 2 times the diameter of said aluminum wire.

8. A process for joining to the terminal end of a solid aluminum electrical conductor wire a copper junction end piece terminating in a pronged configuration whereby said aluminum wire is connectable to an electrical terminal through said copper junction end piece, comprising the steps of a. providing within the die cavity of an extruder a solid cylindrical copper slug having an axially aligned well therein, said well having a diameter slightly greater than the diameter of said wire;

b. inserting said terminal end of said aluminum wire through the exit section of said die cavity into said well of said copper slug;

c. contacting said copper slug with a punch having a diameter equal to that of said slug and two oppositely disposed slots;

d. forcing said punch against said slug simultaneously to forward extrude a portion of said copper slug through said exit die thereby said copper slug is joined to said aluminum wire through plastic deformation by a solid state bond and to backward extrude a portion of said copper slug into said slots thereby to form said pronged configuration.

9. A process for joining directly to the terminal end of a solid aluminum electrical conductor wire a copper junction end piece whereby said aluminum wire is connectable to an electrical terminal through said copper junction end piece, comprising the steps of a. cutting said terminal end of said wire and the contacting end of said junction end pieces to increase their surface areas;

b. immobilizing said terminal end of said aluminum wire;

c. contacting the surface of said contacting end of said copper end junction to be joined to said wire under an axial loading force with the end surface of said aluminum wire; and d. imparting an angular motion to said end piece simultaneously with said contacting thereby to mechanically disrupt and disperse surface oxides on the contacting end surfaces and to form a solid state bond between said aluminum wire and said copper junction end piece, whereby the surface area of said bond is larger than the cross sectional area of said wire normal to the wire axis and extends over a bonding section of finite length and the cross sectional area throughout said bonding section is maintained substantially equal to the cross sectional area of said aluminum wire.

10. A process in accordance with claim 9 wherein said cutting of said terminal end of said wire and of said contacting end of said end piece forms complementary conical surfaces.

11. A process in accordance with claim 9 wherein said cutting of said terminal end of said wire and of said contacting end of said end piece forms complementary hemispherical surfaces.

* * * * *